US009111741B2

(12) United States Patent
Ding et al.

(10) Patent No.: US 9,111,741 B2
(45) Date of Patent: Aug. 18, 2015

(54) ION TRAP WITH PARALLEL BAR-ELECTRODE ARRAYS

(75) Inventors: Chuanfan Ding, Shanghai (CN); Li Ding, Manchester (GB)

(73) Assignee: FUDAN UNIVERSITY, Shanghai (CN)

( * ) Notice: Subject to any disclaimer, the term of this patent is extended or adjusted under 35 U.S.C. 154(b) by 1407 days.

(21) Appl. No.: 12/298,968

(22) PCT Filed: Apr. 13, 2007

(86) PCT No.: PCT/CN2007/001214

§ 371 (c)(1), (2), (4) Date: Jul. 1, 2009

(87) PCT Pub. No.: WO2007/124667

PCT Pub. Date: Nov. 8, 2007

(65) Prior Publication Data

US 2009/0294655 A1 Dec. 3, 2009

(30) Foreign Application Priority Data

Apr. 29, 2006 (CN) ..... 2006 1 006283

(51) Int. Cl.
*H01J 49/42* (2006.01)
*H01J 49/06* (2006.01)

(52) U.S. Cl.
CPC ..... *H01J 49/4235* (2013.01); *H01J 49/065* (2013.01)

(58) Field of Classification Search
CPC ... H01J 49/065; H01J 49/422; H01J 49/4235; H01J 49/4265; H01J 49/403; H01J 49/4275
USPC ..... 250/281, 282, 292, 293
See application file for complete search history.

(56) References Cited

U.S. PATENT DOCUMENTS 5,726,448 A * 3/1998 Smith et al. ..... 250/290
6,545,268 B1 * 4/2003 Verentchikov et al. ..... 250/287
6,621,073 B1 * 9/2003 Dresch ..... 250/287
7,012,250 B1 * 3/2006 Aksyuk et al. ..... 250/292

(Continued)

FOREIGN PATENT DOCUMENTS

GB 2396958 A 7/2004
GB 2413433 A 10/2005

*Primary Examiner* — Brooke Purinton
(74) *Attorney, Agent, or Firm* — Berenato & White, LLC

(57) ABSTRACT

The invention "Ion Trap Array (ITA)" pertains generally to the field of ion storage and analysis technologies, and particularly to the ion storing apparatus and mass spectrometry instruments which separate ions by its character such as mass-to-charge ratio. The aim of this invention is providing an apparatus for ion storage and analysis comprising at least two or more rows of parallel placed electrode array wherein each electrode array includes at least two or more parallel bar-shaped electrodes, by applying different phase of alternating current voltages on different bar electrodes to create alternating electric fields inside the space between two parallel electrodes of different rows of electrode arrays, multiple linear ion trapping fields paralleled constructed in the space between the different rows of electrode arrays which are open to adjacent each other without a real barrier. This invention also provides a method for ion storage and analysis involving with the trapping, cooling and mass-selected analyzing of ions by this apparatus mentioned which constructs multiple conjoint linear ion trapping fields in the space between the different rows of electrode arrays.

11 Claims, 10 Drawing Sheets

(56) References Cited

U.S. PATENT DOCUMENTS

| | | | | |
|---|---|---|---|---|
| 7,351,961 | B2 * | 4/2008 | Malek et al. | 250/291 |
| 7,411,187 | B2 * | 8/2008 | Monroe et al. | 250/290 |
| 8,049,169 | B2 * | 11/2011 | Satake et al. | 250/292 |
| 2002/0024010 | A1 * | 2/2002 | Hager | 250/282 |
| 2004/0135080 | A1 * | 7/2004 | Ouyang et al. | 250/292 |
| 2004/0245455 | A1 * | 12/2004 | Reinhold | 250/288 |
| 2005/0023453 | A1 * | 2/2005 | Bateman et al. | 250/288 |
| 2006/0038123 | A1 * | 2/2006 | Quarmby et al. | 250/292 |
| 2006/0169882 | A1 * | 8/2006 | Pau et al. | 250/281 |
| 2006/0192104 | A1 * | 8/2006 | Schultz et al. | 250/287 |
| 2007/0034810 | A1 * | 2/2007 | Hoyes | 250/396 R |
| 2008/0067363 | A1 * | 3/2008 | Senko | 250/292 |
| 2009/0057546 | A1 * | 3/2009 | Giles | 250/282 |
| 2009/0134321 | A1 * | 5/2009 | Hoyes | 250/282 |
| 2009/0173880 | A1 * | 7/2009 | Bateman et al. | 250/292 |
| 2009/0206250 | A1 * | 8/2009 | Wollnik | 250/290 |
| 2010/0038530 | A1 * | 2/2010 | Giles et al. | 250/283 |

* cited by examiner

ION TRAP WITH PARALLEL BAR-ELECTRODE ARRAYS

CROSS-REFERENCE TO RELATED APPLICATIONS AND CLAIM TO PRIORITY

This application is a National Phase of International Application No. PCT/CN2007/001214 filed Apr. 13, 2007 and relates to Chinese Patent Application No. 200610026283.2 filed Apr. 29, 2006, of which the disclosures are incorporated herein by reference and to which priority is claimed.

FIELD OF THE INVENTION

This invention pertains generally to the field of ion storage and analysis technology and, particularly, to the ion storing components and mass spectrometry instruments which separate ions by characteristics such as mass-to-charge ratio, etc.

BACKGROUND ART

The family of alternating electric fields ion traps for ion storage and mass analysis includes 3-dimension rotational symmetric ion traps (3D-Rot. Sym.IT) and linear ion traps (LIT). In a 3-dimension rotational symmetric ion trap, ions are trapped around the center of the trap. Due to the space-charge effect, the number of ions which may be stored in a 3-dimension rotation symmetric ion trap is limited. Although a large number of ions can be successfully trapped inside a 3-dimension rotational symmetric ion trap, the severe charge-charge interaction between multiple ions will destroy the mass resolution in mass analysis procedure. In a linear trap, ions are stored around a middle axis of the trap. Accordingly, the number of trapped ions within a linear ion trap increases greatly under the same volume density of space charge. Previous research shows that a linear ion trap can trap more than 10 times the number of ions a same scale 3-dimension rotational symmetric ion trap can without obvious space charge effect, and more than a million ions can be trapped with a single ion injection procedure for the next step mass spectrometry analysis. But, under certain conditions, linear ion traps cannot meet all needs. For example, the electric signal of an ion stream in a linear ion trap still needs to be amplified by a high-gain electron multiplier for detection. For the detection of an infinitesimal analyte, the effective signal covered by noises millions folds of analyte cannot be detected. It is therefore necessary to develop greater storage ion traps.

It is known that the storage of trapped ions can be multiplied by simply arraying a group of linear ion traps (see, for example, US Patent Application Publication No. US2004/0135080A1). However, the cost of making a group of simply arrayed linear ion traps is relatively high. Furthermore, ions trapped within different linear ion traps in this type of array eject through corresponding outlet slits of respective ion traps. Accordingly, an ion detector with great receive surface is needed to receive simultaneous ion signals.

SUMMARY OF THE INVENTION

The aim of this invention is to provide a new ion trap array (ITA), with a simple geometry, to carry out parallel, multiplied axis ion storage. Ions stored inside the ITA can be one-off or selectively ejected out of the trap straightway and then be analyzed or detected by electric fields applied on the ITA.

An object of a first aspect of the present invention is to provide ion storage and analysis equipment including two or more rows of parallel placed electrode arrays. The electrode arrays consist of parallel bar-shaped electrodes. Different phases of high frequency voltages are added to adjacent bar electrodes to create a high frequency electric field in the space between two parallel electrodes of different rows of electrode arrays. Furthermore, multiple linear ion trapping fields are paralleled in the space between the different rows of electrode arrays. These linear ion trapping fields are adjacently open to one another without a real barrier.

Also, different phases of alternating current voltages are added on different bar electrodes to create an alternating electric field inside the space between two parallel electrodes of different rows of electrode arrays.

After ions are trapped inside the trapping regions, they will condense into a series of parallel narrow ion cloud strips. An object of a second aspect of the present invention is to provide an ion detection method for exciting, ejecting, and detecting ions in these ion cloud strips selectively, and rapidly ejecting the rest of the ions through the edges or the outlet slits of the electrode array boards.

On the basis of the schemes above, the ion storage and analysis equipment further includes a means for introducing low pressure collision gas which helps to reduce the kinetic energy of the trapped ions and focuses the axes in series, parallel to the bar electrodes mentioned above.

In these pelectrode arrays, the upper electrode arrays and the lower electrode arrays are planar paralleled and edges aligned up and down. Boundary electrodes are set around the volume enclosed by two adjacent rows of parallel electrode arrays.

The sizes of the bar electrodes on each electrode array are the same. The potentials of the boundary electrodes placed on the sides of electrodes array, paralleled to the bar electrodes, are the median of potentials of adjacent bar electrodes in the electrode arrays mentioned above.

The potentials of bar electrodes in the paralleled electrode arrays mentioned above are set according to the sequence: +V, −V, +V, −V, etc. The alternating voltage V contains at least one high frequency voltage component. The potentials of boundary electrodes paralleled to the bar electrodes mentioned above are set to zero.

Such as:

The voltage V is a pure high frequency voltage component.

Or, the voltage V contains a high frequency voltage component and a low frequency voltage component below 1000 Hz.

The invention further has groups of electric switches to create the high or low frequency voltages mentioned above by switching on and off rapidly.

Through holes, outlet slits, or outlet nets are placed on part of the boundary electrodes for ejecting ions out of the ITA.

Through holes, outlet slits, or outlet nets are placed on at least one part of the parallel electrodes arrays for ejecting ions out of the ITA.

The invention further comprises voltage generators and coupling equipment to create dipole fields between two adjacent rows of parallel electrodes arrays for ejecting ions out of the ITA.

The shapes of the bar electrodes are planar, all main surfaces of the bar electrodes are parallel with each other.

On the basis of the schemes above, one or more rows of electrode arrays can be made of Printed Circuit Board (PCB).

The PCBs for planar electrode array construction contains multilayer PCBs with at least one surface layer designed for a planar electrode array shaped pattern.

As mentioned above, the manufacture of electrode arrays includes multilayer PCBs with electric components for mounting and pads for down-leads on at least parts of the electric conductive layers.

In this invention, the two rows of electrodes arrays can be made of two separate PCBs fixed together by several boundary electrode boards.

This invention also includes an ion detector to detect ejected ions. The detector should be located at the end of one of the ion trapping axis and outside the ITA.

This invention also includes an ion detector to detect ejected ions. The detector should be placed outside one of the boundary electrodes parallel to the ion trapping axes mentioned above.

This invention also includes an ion detector locate outside one column of the electrode array, which detects ions ejected out from this electrode array through silts or nets.

This invention also includes means to trap and analyze ions, which includes a parallel electrode arrays consisting of bar electrodes paralleled to each other. Alternating current (AC) voltages, with different phases, are assigned to the bar electrodes to create alternating electric fields between corresponding pairs of bar electrodes. Furthermore, multiple conjoint linear ion trapping fields are constructed in parallel in the space between the rows of electrode arrays. The ions can be trapped inside these fields and cooled down, then be separated and analyzed by their mass to charge ratio differences.

On the basis of the method above, the means to analyze ions includes assigning signals to the arrays to exclude all ions other than those having a certain mass to charge ratio, and then detecting the ejected ions one at a time.

A method of excluding ions includes superposing a low frequency signal, below 1000 Hz, beside high frequency AC voltages assigned to the electrode arrays, which makes ions trapped have maximal and minimal m/z ratios.

A method of excluding ions also includes adding a dipole excitation field between the parallel electrodes to eject certain m/z ions out by the resonance excitation between the ions' secular motion and the dipole field.

A method of detecting ejected ions one at a time includes decreasing the DC voltage on the electrodes at the end of the bars to educe the positive ions out through the slits or nets of the corresponding electrode, or increasing the direct current (DC) voltage on the electrodes at the end of the bars to educe the negative ions out through the slits or nets of the corresponding electrode, and then detecting the ion flow using ion detectors.

A method of detecting ejected ions one at time also includes applying an electric field parallel to the electrode array, which is called the X direction, to accelerate the ions and eject them out through either side of the array, and then detecting the ion flow using ion detectors.

A method of detecting ejected ions one at a time further includes applying an electric field vertical to the electrode array, which is called the Y direction, to accelerate the ions and eject them out through silts of either sides of the array, and then detecting the ion flow using ion detectors.

A method of ion separation includes scanning the voltage or frequency of the high radio frequency which is trapping the ions, and ejecting the ions following a sequence of m/z ratios. The detector outside the array receives a signal and forms a spectrum according to the m/z ratios.

The detector mentioned above is placed at the end of one of the ion trapping axis outside the parallel electrode array, and the ions can be ejected out through the silts or the nets on the boundary electrodes and enter into the detector mentioned above.

Furthermore, in this invention, adding an AC voltage between the parallel electrodes to form a resonance excitation field vertical to the electrode array to eject ions out follow the sequence of the m/z ratios by the resonance excitation between the ions' secular motion and the dipole field. The ions can pass through the silts in the electrode bars and reach the detector to be detected.

Also, in this invention, adding an AC voltage on adjacent bar electrodes of one of the bars to form a resonance excitation field parallel to the electrode array, which is the X direction, ejects ions following the sequence of the m/z ratios by the resonance excitation between the ions' secular motion and the dipole field. The ions can pass through the space between the electrode arrays and reach the detector to be detected.

When the AC voltage is produced by the groups of electric switches, the waveform is square wave.

When the number of electric switches groups which bring the square wave mentioned above is two, the phase difference between the square waves produced by two adjacent groups is 180 degrees.

If the number of electric switches groups mentioned above is greater than two, then the phase difference between the square waves produced by two adjacent groups is equal to the sum of 180 degrees and a certain increment, and both the periodic ion trapping fields and traveling wave fields are constructed in the space between the different rows of electrode arrays.

Furthermore, if the number of electric switches groups mentioned above is greater than two, and the phase difference between the square waves produced by two adjacent groups is equal to 180 degrees, but a modulation appears every N periodic wave length or phase, the modulation waves travel in the X direction.

The traveling wave fields mentioned above eject the ions out.

Each ion trapping unit, which comprises N bar electrodes with different phased AC voltages applied thereon and wherein N is equal to or greater than 1, can be optimized by adjusting the proportion of the voltages applied on each bars.

Furthermore, each ion trapping unit, which comprises N bar electrodes with different phased AC voltages applied thereon and wherein N is equal to or greater than 1, can be joined up together because the number N is changed by changing the voltages applied on each of the bars, and ions trapped in different axes can be joined up together.

This invention also includes a means to trap and analyze ions which includes more than two parallel electrode arrays having bar electrodes paralleled to each other. AC voltages with different phases are assigned to the bar electrodes to create alternating electric fields between each pair of bar electrodes. Furthermore, multiple conjoint linear ion trapping fields are constructed in parallel in the space between the different rows of electrode arrays. Ions can be trapped inside these fields, cooled down, and then separated and analyzed by their mass to charge ratio differences.

FIG. 1 is the rationale for this invention. There are two rows of electrode arrays, an upper one and the lower one, which are designated (1) and (2) respectively. The electrode arrays are in the X-Z plane, and are parallel to each other. In FIG. 1 both the upper and the lower electrode arrays include four strips of monospaced rectangular electrodes (11.1, 12.1, 13.1, 14.1), and the corresponding electrodes in upper and lower electrode arrays have the same breadth and edge alignment. For each electrode array, high-frequency voltages of +, −, +, − phase are added to each electrode in turn. There is upright border electrode (3.1) on both left and right ends of the electrode arrays, to which a median potential of "+" phase (odd number) electrode and "−" phase (even number) electrode potentials are added. Under the conditions shown in FIG. 1 the potential is zero.

According to the research, we find in the case mentioned above the electric field between two parallel electrode arrays is multi-repeated high frequency electric field that is primarily a quadrupole field. The isoline of the field is shown as (5) in FIG. 1. If the parallel electrode arrays extend long enough in the Z direction, the electric field becomes a planar field which is independent of Z. On the upright plane, in the middle of every pair of odd number electrode and even number electrode, the potential is always zero, which equals an electrode of zero potential being put there. Therefore we do without upright electrodes which surround ion trapping area, and can form an electric field that is similar to that of a planar quadrupole ion trap. This also repeats one after one in the X direction. The center of every corresponding upper and lower electrode is also an ion trapping center shown as (6) in FIG. 1. Ions with certain m/z ratios either made outside or inside, after cooling down by the collision with neutral gas, will be assembled around the center axes in the Z direction.

Also, several rows of parallel electrode arrays can form a more complex linear ion trap array system. As shown in FIG. 2, three rows of parallel electrode arrays (3, 4, 5) make up a linear ion trap. In the same way, each row of electrodes is in the same plane (called the X-Z plane in this case). The three planes which are the upper plane, the middle plane, and the lower plane are all parallel to each other. In FIG. 2 the upper, middle and lower electrode arrays all consist of four strips of monospaced electrodes (11.2, 12.2, 13.2, 14.2), and corresponding electrodes in upper and lower electrode arrays have equal breadth and edge alignment. High-frequency voltage of +, −, + − phases are added to each electrode array in turn. There is upright border electrode (3.2) on both the left and right ends of electrode arrays, to which the median potential of "+" phase (odd number) electrode and "−" phase (even number) electrode potentials are added. Under the conditions shown in FIG. 2 the potential is zero.

DESCRIPTION OF THE FIGURES

FIG. 5(A) is rectangular shaped and FIG. 5(B) is elliptical shaped. In these ways the upper and lower electrode bars (shown as 11, 12, and so on) are connected by small plates at the ends (shown as 11.2, 12.1) instead of median potential border electrodes mentioned above.

DETAILED DESCRIPTION

Figure 3:
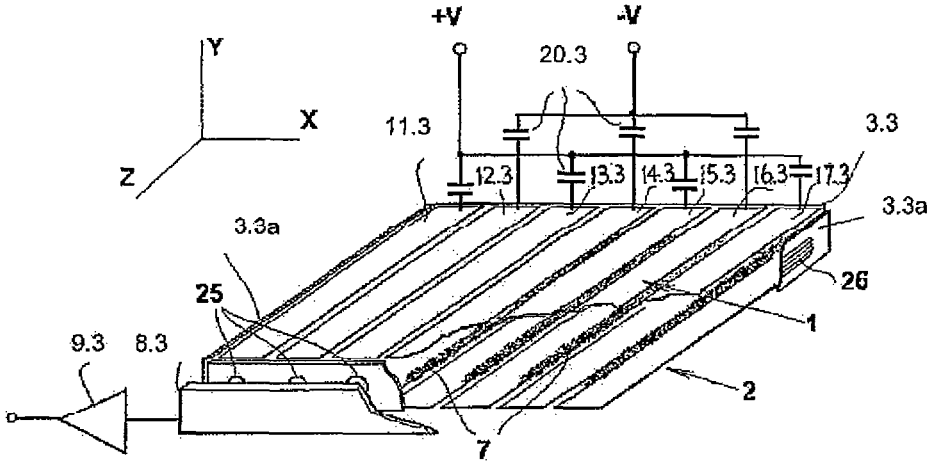
FIG. 3 shows a practical application of the invention.

Case 1:

FIG. 3 shows a method of the invention. The upper electrode array (1) and lower electrode array (2) both include seven rectangle electrode bars, namely, (1.3, 12.3, 13.3, 14.3, 15.3, 16.3, and 17.3). The electrode bars are made of metal plate, and have the same length in the Z direction, the length of each electrode bar is at least 3 times greater than the breadth of said electrode bar in the X direction (approximately tens of millimetres). The distance between the upper and lower electrode arrays is similar to the sum of the breadth of an electrode bar and the interval between two adjacent electrode bars, generally a few millimetres. The difference is less than 25%. Border electrodes (3.3 and 3.3*a*) are placed around the planar electrode arrays as the boundary of ion trap field. Electrode (3.3*a*) is placed on the boundary of paralleled electrode bars on Z direction and electrode (3.3) is placed next to the ends of electrode bars. Border electrodes have inlet holes, silts (25) or nets (26), so that the ions can easily be introduced and ejected out. High frequency electrical sources +V and −V are applied to the electrode arrays by a capacitor coupling (20.3), and in each pair the upper and lower electrode bars are jointed together. The odd number electrode bars (11.3, 13.3, 15.3, 17.3) are connected to electrical source +V while the even number electrode bars (12.3, 14.3, 16.3, 18.3) are connected to electrical source −V. A high frequency electric field, which is formed in an ion trapping area between the upper and lower electrode arrays, can trap ions in both the X and Y directions. After ions are trapped, an axial ion cloud condenses between every pair of upper and lower rectangle electrode bars. If the potential of border electrode (3.3) is above or same to the potential of border electrode (3.3*a*), which is grounded, they can block ions axially (when ions are close to boundary electrodes, they will be blocked on the Z direction). If a negative voltage is applied to the border electrodes, the block force of border electrodes is not greater than the suction force; accordingly ions can be ejected through the outlet hole (25) in the Z direction. A detector (8.3) is placed after the boundary electrode (3.3) for ions stream detection described above. The output signal is amplified by the amplifier (9.3) and recorded by the controller computer.

In this case, the ions are ejected and detected in the Z direction (axially).

Figure 4:
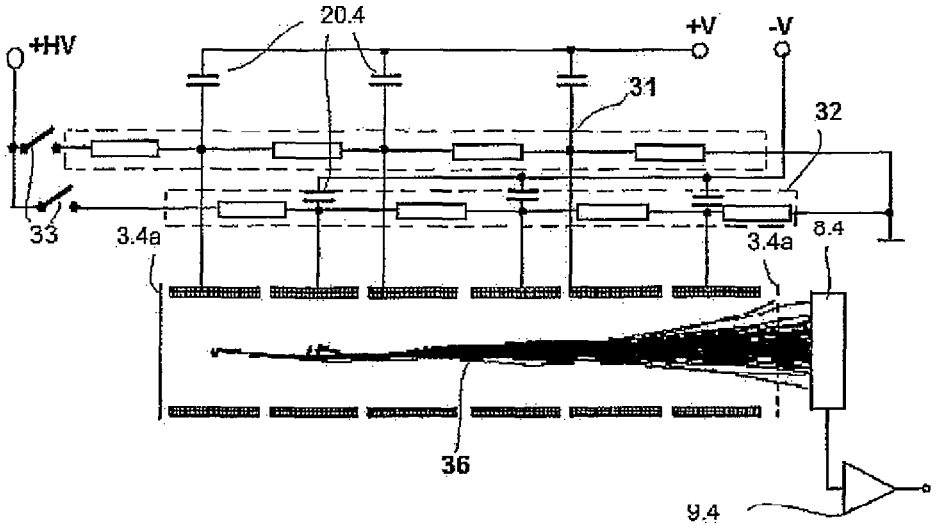
FIG. 4 shows how ions are ejected out and then detected in the X direction (transverse).
Figure 5:
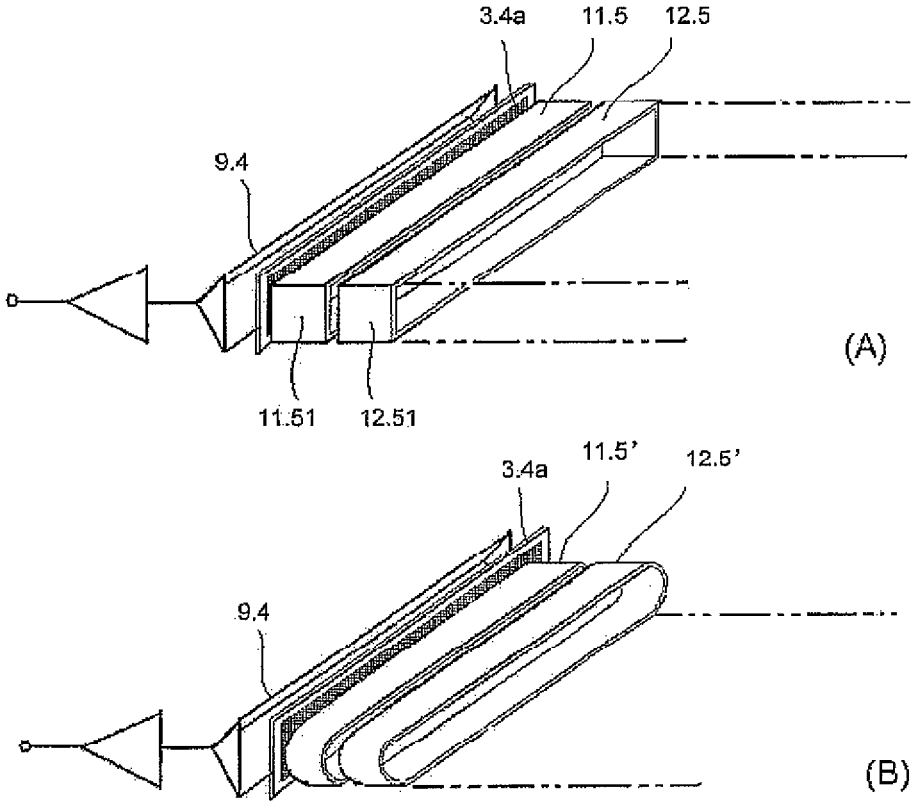
FIG. 5 shows a method of joining the upper and the lower electrodes together.

Case 2:

FIG. 4 shows another method in which ions are ejected and detected in the X direction. In FIG. 4, the detector (8.4) is placed outside the reticulate boundary electrode (3.4*a*). After trapped and mass-selected, ions are accelerated by an extractive pulse electric field which was produced by the resistor network (31, 32), and then pass through the boundary electrode (3.4*a*) on the right and hit the detector (8.4). Although in the FIG. 4 the resistor network (31, 32) are only connected to electrodes of the top electrode array, identical potential is applied to corresponding, opposite electrodes of the bottom electrode array. In cases where identical is potential applied on opposite electrodes, boundary electrodes can be manufactured as shown in FIG. 5: the ends of every electrode (11.5, 12.5, etc.) is joint directly with end plates to corresponding opposite electrodes (11.51, 12.51, etc.) without a zero-potential boundary electrode, and in such case, two electrodes on the opposite side are united as one rectangle frame, or even ellipsoid frame electrode FIG. 5(B).

It will be understood that the potential applied to opposite electrodes of the top and bottom array can be different, for example, a dipole excitation voltage can be applied between them to eject or excite ions.

Figure 6:
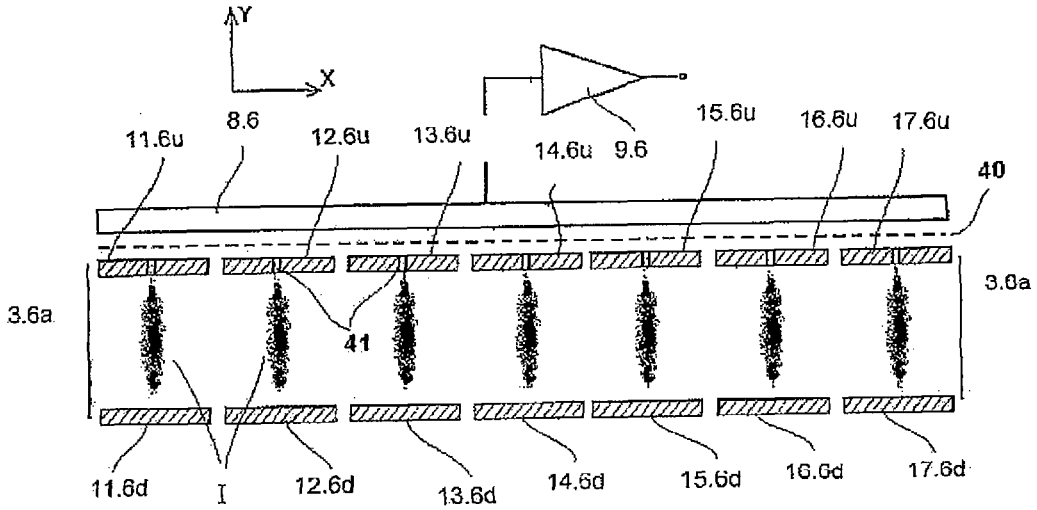
FIG. 6 shows how ions are ejected out and detected in the Y direction.

FIG. 6 shows another method of ejecting and detecting ions in the Y direction. There is a slit (41) in each electrode in the electrode array, and these slits are parallel to the electrodes. Outside the slits, there is an ion detector (8.6) which has an area big enough to cover all the slits. A reticulate electrode (40) may be placed between the ion detector (8.6) and slits to shield interference from a high-frequency signal. After ions are captured and selected, with a dipole excitation signal applied on the electrodes, the ions accelerated in the Y direction and pass through the slits (41) and reticulate electrode (40), and then hit the ion detector (8.6).

Similar to other linear quadrupole ion traps, ions in the stability region can be trapped. If the potential applied on the electrodes are pure alternative current signal +V, −V, ions will be trapped mass selectively and a low mass-to-charge ratio cut-off will exist. This means ions with a mass-to-charge ratio lower than a particular value (low mass limit) will hit the electrodes and be lost. For example, if we want to detect a contaminated gas, whose molecular weight (M) is usually greater than that of air, we can adjust the low mass limit to a little less than (M) so ions of air molecular will be eliminated. The remaining ions in the trap are primarily from the contaminated gas and can be detected by the detector by decreasing the potential of electrode (3.6).

However, the method described above has low mass resolution and sensitivity. If we add a direct current voltage or a low-frequency voltage to the trapping voltage, then the stability region in a-q space has a certain upper limit of mass-to-charge ratio, which means ions whose mass-to-charge ratio are greater than the upper limit will hit the electrode array and be lost. Therefore, we can combine the two methods together. First ions are captured in the ion trap, then we can use the lower limit and upper limit of mass-to-charge ratio of the stability region to filtrate ions, and only ions with a particular mass-to-charge ratio remain in the ion trap. We can then detect ions using the above described method of ejecting ions. Since low-frequency signals can be coupled to trapping voltage using capacitors, in some situations it is advantageous to add a low-frequency AC voltage than to add a DC voltage to trapping voltage.

Figure 7:
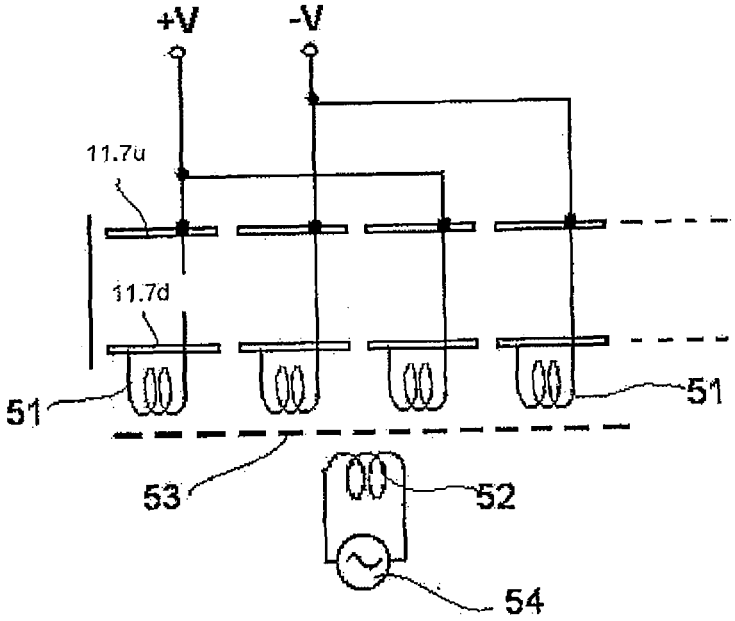
FIG. 7 shows a circuit diagram used to superpose a dipole exciting electric field in the Y direction.

Another method of band-pass filtering of ions includes applying a dipole excitation electric field between the top and bottom electrodes. The dipole excitation signal will resonantly excite unwanted ions and these ions will be excited and hit the electrodes and be lost. FIG. 7 shows a circuit of adding dipole excitation electric field in the Y direction. In FIG. 7, corresponding top electrode (11*u*) and bottom electrode (11*d*) are not connected directly but through a transformer coil (51). All elementary coils (52) and subsequent coils (51) are coiled on the same magnetic core to form a multi-subsequent coil transformer. Various signals of different frequency are generated by signal generators (54) and are coupled to each corresponding electrode by the multi-subsequent coil transformer. If we adjust the frequency of the signal we can eject unwanted ions and leave wanted ions to be detected.

The examples given above are methods of ejecting unwanted ions and maintaining wanted ions in the ion trap. These are efficient methods to detect particular ions, but mass spectrum cannot be achieved efficiently by these methods. The mass-selective detection methods discussed below are simple methods to get a mass spectrum. Some of the methods are also can be used to capture ions mass-selectively.

Applications

Figure 1:
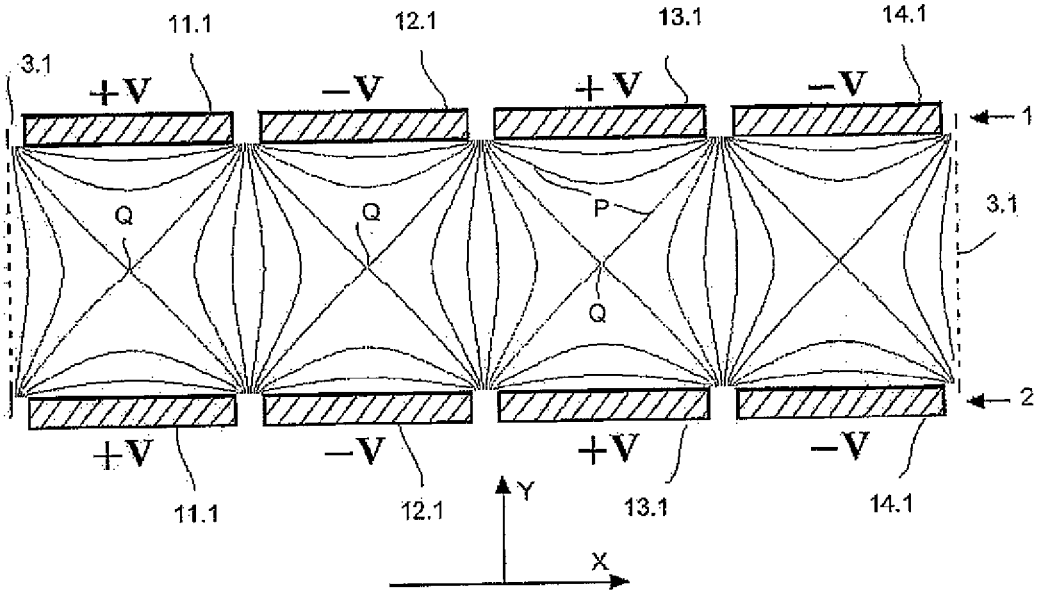
FIG. 1 is a fundamental drawing of this invention.

Method A:

As shown in FIG. 1, ions with different masses are captured and cooled by a quadrupole field. A lower voltage is applied to the boundary electrode (3) which is closer the detector, but it can still trap the ions. Then we scan the amplitude (or frequency) of the radio frequency voltage which yields the quadrupole field. Ions by mass to charge ratio are pushed to the boundary of the stability graph. As the kinetic energy increases once ions are moved to the boundary of the stability graph. There is a threshold kinetic energy, above which ions can traverse the boundary electrode (3) and eject towards the detector. The signal forms a spectrum followed by the mass to charge ratio.

In this method, coils (51, 52) are used to superpose a Y-directed dipole excitation electric field with a fixed frequency, ions are then excited by mass to charge ratio order, this electric signal coupled method is shown in FIG. 7. There is a threshold kinetic energy, above which ions can traverse the boundary electrode (3). As the kinetic energy of the excited ions increases they are ejected towards the detector and form the mass spectrum.

Method B

In this method, we use the structure shown in FIG. 6 and the electric signal coupled method shown in FIG. 7. The distance between the upper and lower electrode arrays should be larger than the summation of the width of the electrode and the gap. Compared to square, every cross section of 2D-ion trap stretched in the Y direction, yields a positive multipole field (mainly octopole) in the Y direction. When ions with different masses are captured and cooled by the quadrupole field, a Y-directed dipole excitation electric field with a fixed frequency is superposed by using coil (51, 52). Simultaneously we scan the amplitude (or frequency) of the radio frequency voltage which yield the quadrupole field, so the captured ions can be excited followed the mass to charge ratio order. As the kinetic energy and resonance amplitude in the Y direction increases, ions are ejected selectively the slit (41) and detected by the detector to yield a mass spectrum.

Method C

Figure 8:
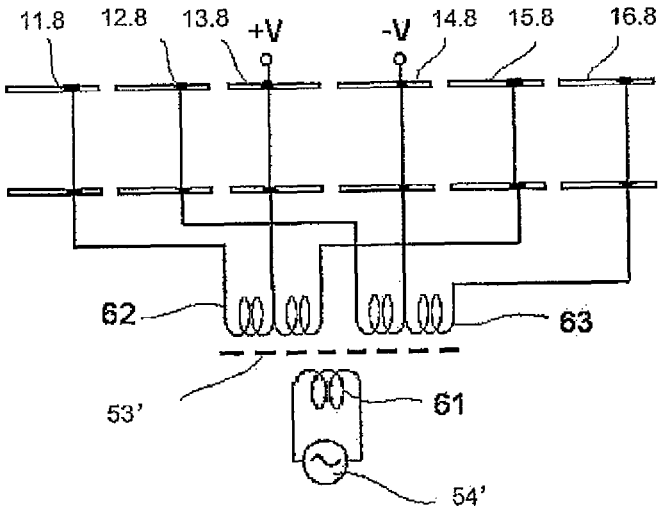
FIG. 8 shows another circuit diagram.

Using structure similar to as shown in FIG. 4, this yields a ladder field in the X direction when switch. (33) is closed and can be used as dipole excitation electric field. Ions can be resonance excited selectively while any resonance occurs between the open-closed frequency of the switch (33) and the movement of the ions in the X direction. Some excited ions can traverse into other capture regions and the boundary electrode (3*a*) to the detector (8). We can also use the circuit shown in FIG. 8 where corresponding electrodes of the upper and lower arrays are connected. Signals generated by dipole excited signal source (54') are applied to the region between electrodes (11.8, 13.8, 15.8) by coupling coil (61, 62), similarly, signals are applied to the region between electrode (12.8, 14.8, 16.8) by coupling coils (61, 63). Thus, there is a periodic potential difference between the right and left area of every ion-captured region. This forms a dipole excitation electric field in the X direction in every ion-captured region. Ions are resonance excited, ejected, detected selectively by their mass to charge ratio order.

Method D

Figure 9:
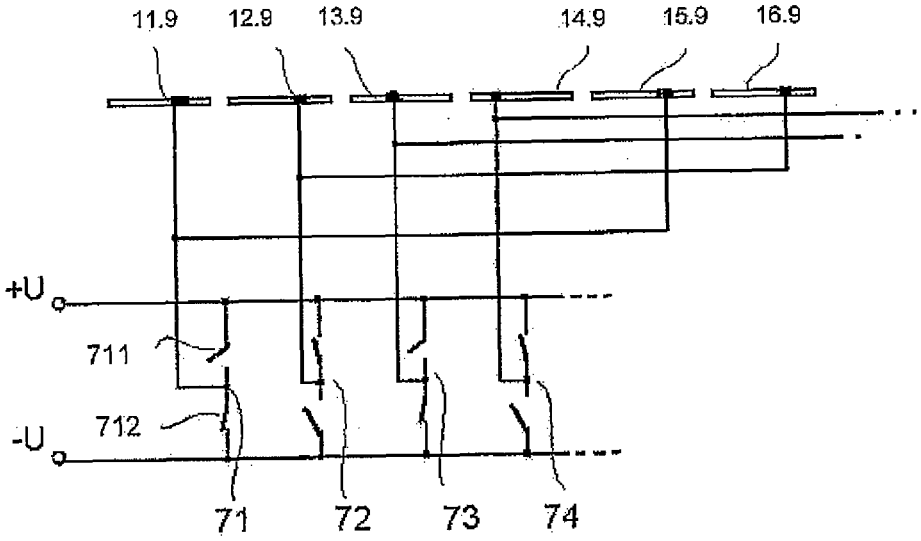
FIG. 9 shows how to produce a quadrupole trapping electric field with square waves by switch arrays.

Captured electric field and superposing dipole excitation electric field in the X direction are still needed in this method. As shown in FIG. 9, square wave quadrupole-trapping electric fields are generated by switch group (71, 72, 73, 74). Each unit in a switch array, such as switch group (71) has a pair of switches (71.1,71.2) which switch on and switch off alternatively, and which generate a square wave voltage with a fixed frequency applied to the voltage to electrode (11.9). If there is a phase difference of 180° between the alternation of switch group (72) and switch group (71) and there is a phase difference of 360° between the alternation of switch group (73) and switch group (71), the electrode array can generate a trapping radiofrequency electric field +V and −V as demonstrated before; If the phase difference between adjacent switch groups is not 180°, but has an additional increment $^{\Delta}$theta, there will be an odd-function multipole field such as dipole, hexapole in the X direction in addition to the trapping radio frequency electric field (quadrupole, octopole, dodecapole etc.). The frequency of these fields is same to the alternative frequency generated to trap the field and can move along the X axis, and named as travelling wave. It can transport ions to one side and be useful in one-off ion ejection. If the increment $^{\Delta}$theta of alternative phase difference does not appear in every wave, but once in N waves, so the generated dipole frequency is N-frequency-division of the trapping-field frequency. This N-frequency-divided dipole field can be set as dipole excitation electric field in the X direction, and it can be used to excite the secular frequency of ion oscillation and eject ions selectively.

Figure 11:
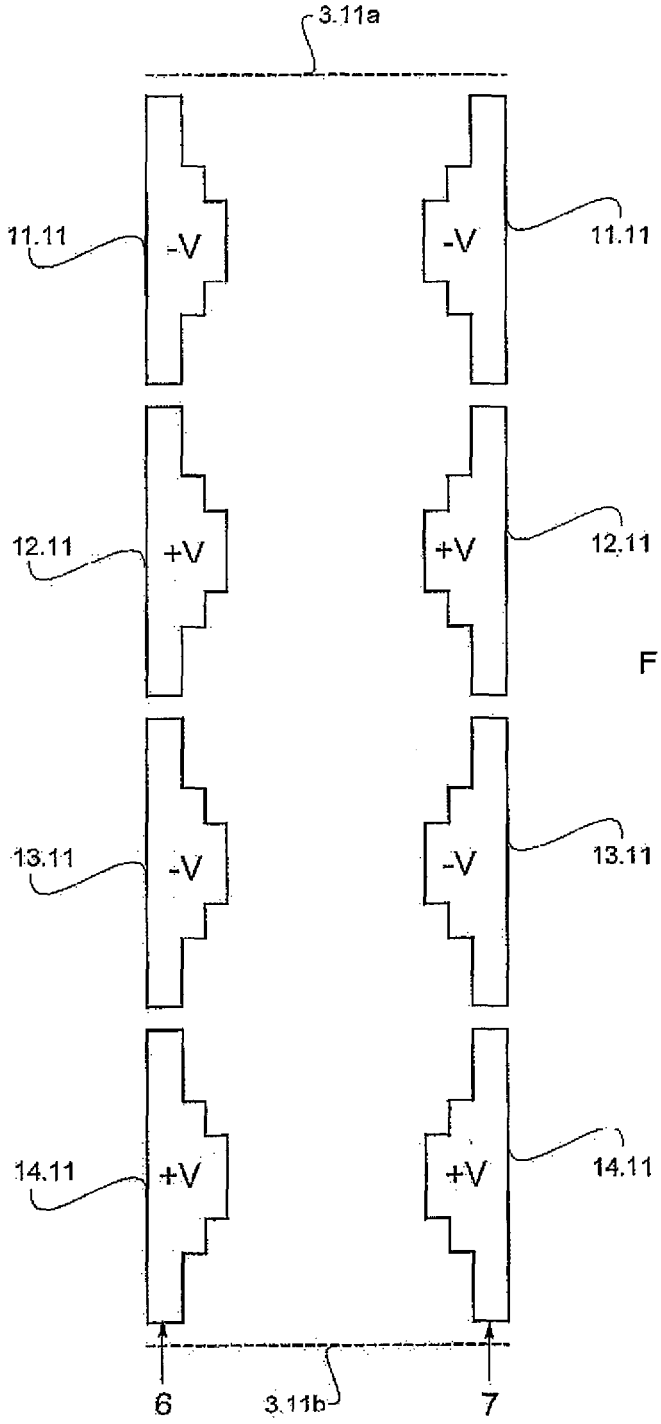
FIG. 11 is a section of electrode bars which are in shape of a ladder.

There are many ways to manufacture the electrode array. As shown in FIG. 1, an electrode bar in the array can be flat board or rectangle column electrode whose section is rectangle. The section of the electrode bar can also be polygon or ladder shape as shown in FIG. 11. FIG. 11 shows a linear ion trap system formed by two parallel electrode arrays (6) and (7). Each electrode array is arranged in a plane (named X-Z plane). The upper plane is parallel to the lower one. In this demonstration, there are three electrode arrays, upper, middle and lower one, each array contains 4 flat electrodes with same width (11.11, 12.11, 13.11, 14.11), the width of corresponding electrodes in the upper and lower electrode arrays is equal. A +, −, +, − phase high frequency voltage is applied to each electrode in each electrode array. There are boundary electrodes (3.11*a*, 3.11*b*) at right and left side of the array and perpendicularly to the array planar, the applied potential of the boundary electrode is the median of the odd electrode potential and even electrode potential. In this example, the potential is 0.

Figure 12:
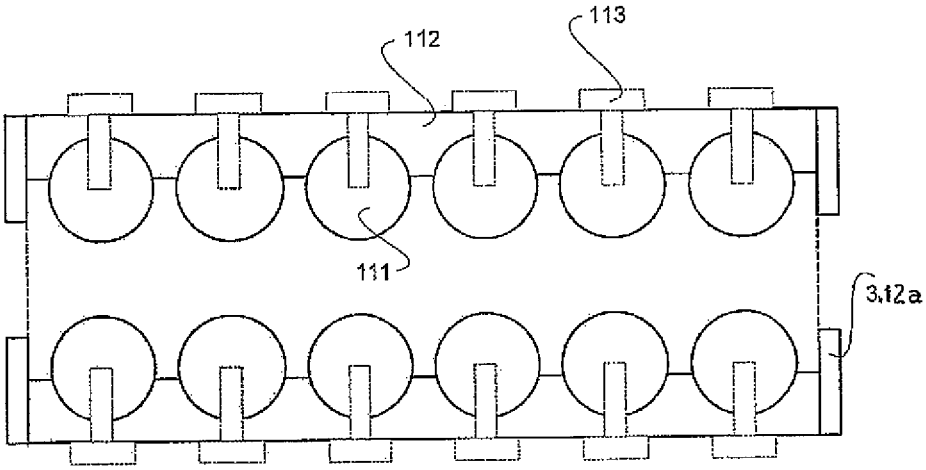
FIG. 12 is the section of electrode bars which are in the shape of a hyperboloid or column.

As shown in FIG. 12, the electrode array can also be manufactured using a columniform or part-columniform electrode; an electrode with a hyperboloidal or part-hyperboloidal section is a feasible method too. The electrode may be fixed to form an electrode array by jointing or adhesive. The electrode array shown in FIGS. 10 and 12 may also be formed by fastening the electrode to bracket (112) by bolt (113). The electrode array can even be fabricated by using PCB board directly.

Figure 2:
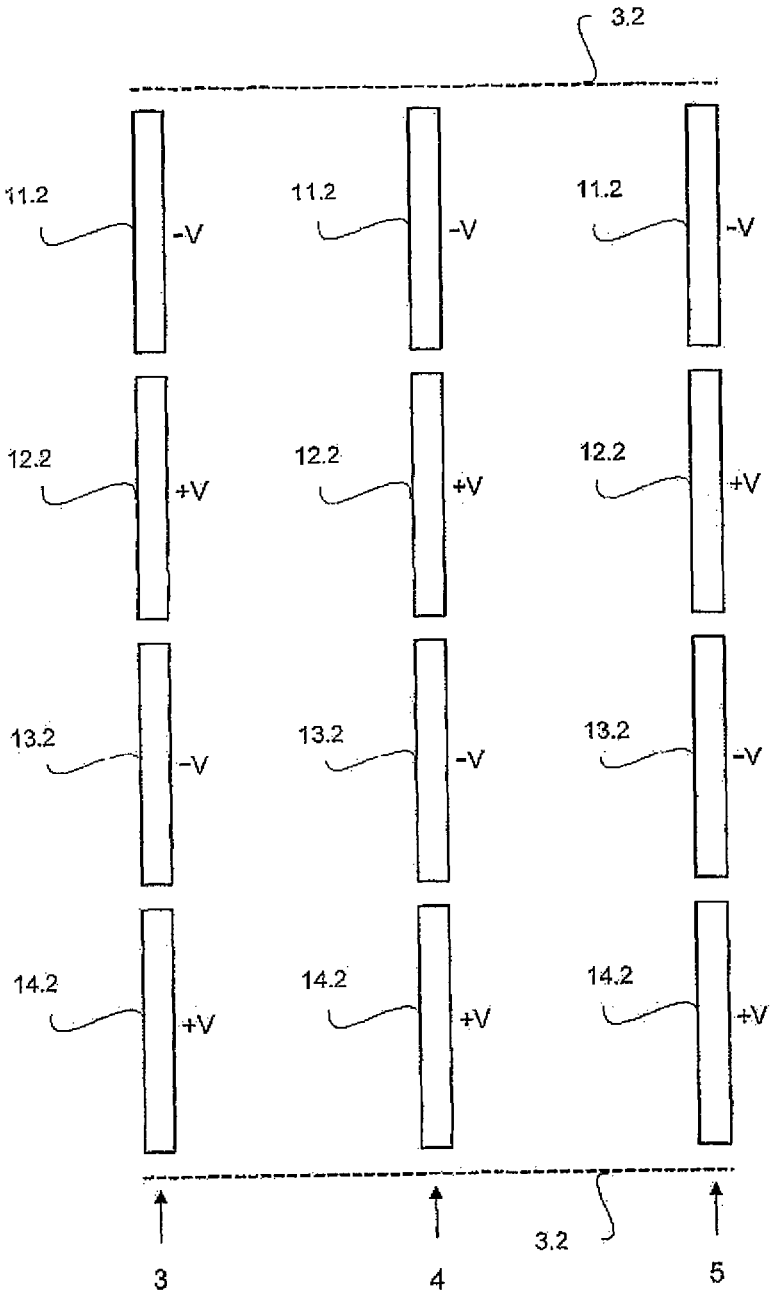
FIG. 2 shows a linear ion trap including three rows of parallel electrode arrays (3, 4, 5).
Figure 10:
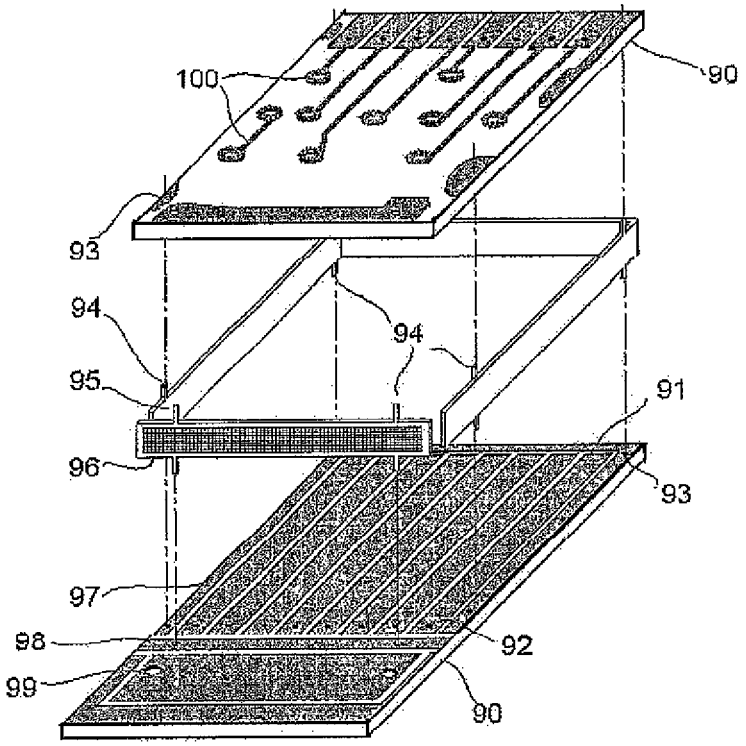
FIG. 10 shows how to use two PCB boards as electrodes to make an ITA.

FIG. 10 shows a method of constructing a planar-electrode ion trap array with two print circuit boards PCBs (90). Each PCB has two layers. One layer is printed with electrode array (91) and electric strips (97, 98) and is used for connecting boundary electrodes. Another layer is printed with electric pads and lines (100). Electric strips or lines in two layers are connected with via-orifice (92) if necessary. Boundary electrodes (94, 96) are made in metal board or slice, and the grids on them can be manufactured using chemical methods. The claws (94) on the boundary electrodes plug into orifice (93) on the PCBs and join the two PCBs together. There should be other orifices (99) on the PCBs to install detectors or other devices. In the construction of the multi-row linear ion trap mentioned in the FIG. 2, the middle PCBs should be both surface layer conductive patterned by electrode array (91). The circuit connection (100) can be placed on the inner conductive layer of the middle PCBs.

Figure 13:
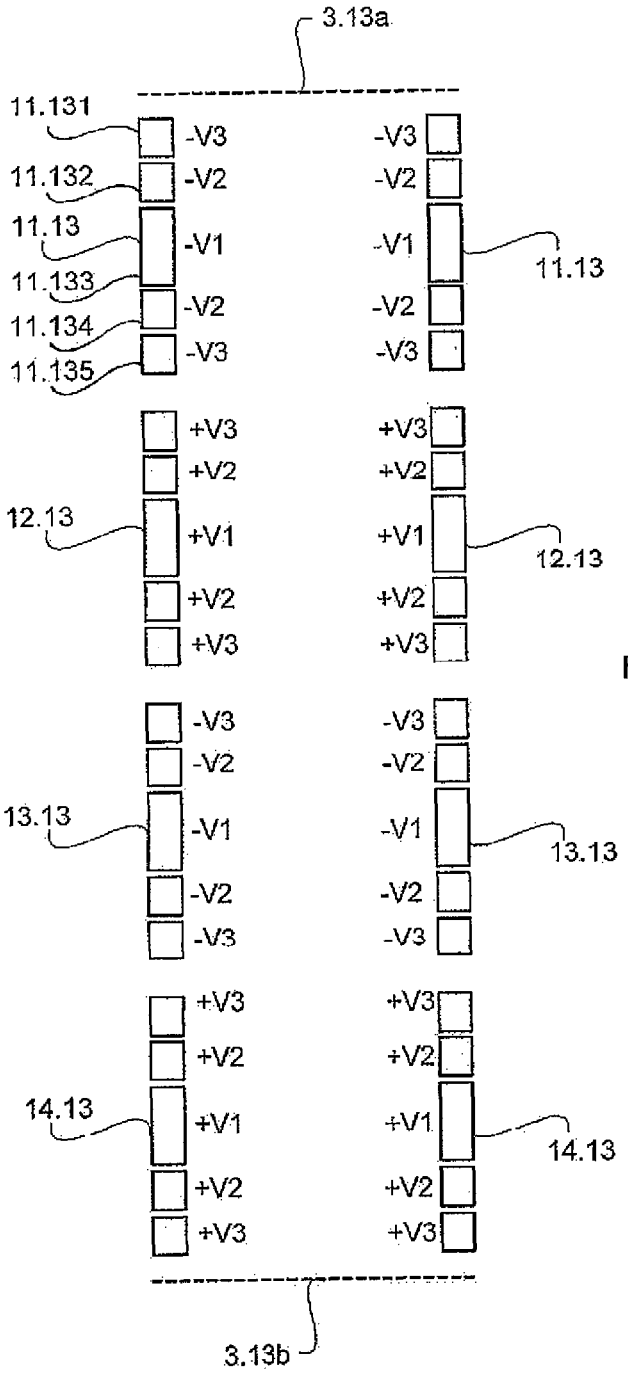
FIG. 13 shows a linear ion trap system that is made of two rows of paralleled electrode arrays.

In the methods described above, a trapping region is formed by two electrodes (the top and the bottom) and only a single voltage is applied to the electrodes. As shown in FIG. 13, each electrode may be divided into several electric strips. Each electrode array is on the same plane, and two planes are parallel. In this case, both the top and bottom electrode array contain four planar electric strips (11.13, 12.13, 13.13, 14.13) having the same width. Corresponding electric strips in the top and bottom electrode arrays have the same width and are symmetrically placed on the opposite to each other. The polarities of high-frequency voltages applied on adjacent electrodes are opposite. Each electrode is composed of several different electric strips (11.131, 11.132, 11.133, 11.134, 11.135) which are specially designed. Different voltages can be applied to each electric strip to adjust electric field. For example, we can apply −V1 to electric strip (11.133), apply −V2 to electric strips (11.132, 11.134), and apply −V3 to electric strips (11.131, 11.135). In practical applications, the ratio of V1, V2 and V3 may be adjusted to adjust the electric field to improve the performance of the ion trap. Vertical boundary electrodes (3.13*a*, 3.13*b*) are placed at both right and left ends of the electrode array. The potentials of these electrodes are set to the median of the odd electrodes and even electrodes, ground in this example.

While each electrode unit is formed by several exiguous bar electrodes, the electric field generated can be optimized by adjusting +V to −V ratio in each exiguous electrode, such as superposing or eliminating certain multipole field as required.

Alternatively, ion trapping methods described above which apply one voltage, +V or −V, to one ion-captured unit incorporate several ion-trapping fields by applying proportional voltage to each electrode bar.

There are many ways to construct parallel electrode ion trap array that we can not enumerate everyone here. However, if the electric field mentioned above is achieved, the parallel electrode ion trap array may work modes. We just list some instances above. The ion trap array can easily provide more handle modes to experts in this domain. For example, after being selected subsistent ions can be detected by spectroscopic analysis or light dispersion method. Additionally, ions can also be transported to other spectrum analyze instrument, such as Time-Of-Flight, Ion Mobility Spectrum, OBITRAP etc. These applications should be considered as included in this patent.

The invention claimed is:

1. An apparatus for ion storage and analysis comprising:

at least first and second parallel spaced-apart electrode arrays, the first electrode array comprising a first row of at least two first bar electrodes, the second electrode array comprising a second row of at least two second bar electrodes, the first bar electrodes of the first electrode array being in corresponding arrangement with and facing the second bar electrodes of the second electrode array to establish a plurality of paired facing bar electrodes;

a power supply for applying phases of alternating current voltages to the first and second bar electrodes to create alternating electric fields in spaces between the first and second bar electrodes of the paired facing bar electrodes, wherein the first bar electrodes of the first electrode array and the second bar electrodes of the second electrode array are configured to alternate between a positive phase voltage and a negative phase voltage; and parallel linear ion trapping regions formed in the spaces between the corresponding first and second bar electrodes of the paired facing bar electrodes, the ion trapping regions being adjacent to one another, wherein the adjacent ion trapping regions are in communication with one another, wherein at least one of said first and second bar electrodes is provided with an opening through which ions may be ejected from the apparatus.

2. The apparatus of claim 1 further comprising boundary electrodes disposed at opposite ends of the first and second electrode arrays.

3. The apparatus of claim 2 wherein the boundary electrodes has a potential equal to a median of the potentials of the corresponding first and second bar electrodes.

4. The apparatus of claim 1 wherein the alternating current voltages comprise a high frequency voltage component and a low frequency voltage component, the low frequency voltage component being below 1000 Hz.

5. The apparatus of claim 1 further comprising electric switches for creating high or low frequency voltages.

6. The apparatus of claim 2 wherein at least one of said boundary electrodes is provided with an opening through which ions may be ejected from the apparatus.

7. The apparatus of claim 1 further comprising a voltage generator and coupling equipment for creating dipole fields between the first and second electrode arrays.

8. The apparatus of claim 1 further comprising an ion detector for detecting ions ejected from the apparatus.

9. The apparatus of claim 1 wherein at least one of said electrode array is formed out of a Printed Circuit Board.

10. The apparatus of claim 1 wherein there is an unobstructed passageway between said ion trapping regions.

11. A method for ion storage and analysis comprising the steps of:

providing an apparatus for ion storage and analysis, the apparatus comprising at least first and second parallel spaced-apart electrode arrays, the first electrode array comprising a first row of at least two first bar electrodes, the second electrode array comprising a second row of at least two second bar electrodes, each of the first bar electrodes facing a corresponding one of the second bar electrodes of the second electrode array to establish a plurality of paired facing bar electrodes, the apparatus further comprising boundary electrodes disposed at opposite edges of the first and second electrode arrays;

assigning alternating current voltages to the first and second bar electrodes to create alternating electric fields in spaces between the first and second bar electrodes of the paired facing bar electrodes, wherein the first bar electrodes of the first electrode array and the second bar electrodes of the second electrode array are configured to alternate between a positive phase voltage and a negative phase voltage; and;

forming parallel linear ion trapping regions in the spaces between the corresponding first and second bar electrodes of the paired facing bar electrodes;

trapping and cooling ions in the ion trapping regions;

ejecting ions from the apparatus based on mass to charge ratio differences of the ions; and detecting and analyzing the ejected ions, wherein at least one of said first and second bar electrodes is provided with an opening through which the ions may be ejected from the apparatus.

* * * * *

UNITED STATES PATENT AND TRADEMARK OFFICE

CERTIFICATE OF CORRECTION

PATENT NO. : 9,111,741 B2
APPLICATION NO. : 12/298968
DATED : August 18, 2015
INVENTOR(S) : C. Ding et al.

It is certified that error appears in the above-identified patent and that said Letters Patent is hereby corrected as shown below:

On the title page, item 30

The number of the foreign priority application should be CN --200610026283.2-- instead of CN "2006 1 006283".

Signed and Sealed this
Twenty-second Day of December, 2015

Michelle K. Lee

Michelle K. Lee
*Director of the United States Patent and Trademark Office*